US010697167B2

(12) United States Patent
Bucher et al.

(10) Patent No.: US 10,697,167 B2
(45) Date of Patent: Jun. 30, 2020

(54) WALL-HUNG TOILET WITH IMPROVED LOAD-BEARING CAPACITY

(71) Applicant: AS AMERICA, INC., Piscataway, NJ (US)

(72) Inventors: Christophe Bucher, Hillsborough, NJ (US); David Grover, Hamilton, NJ (US)

(73) Assignee: AS AMERICA, INC., Piscataway, NJ (US)

( * ) Notice: Subject to any disclaimer, the term of this patent is extended or adjusted under 35 U.S.C. 154(b) by 13 days.

(21) Appl. No.: 15/646,513

(22) Filed: Jul. 11, 2017

(65) Prior Publication Data

US 2017/0306606 A1 Oct. 26, 2017

Related U.S. Application Data

(63) Continuation of application No. 14/522,413, filed on Oct. 23, 2014, now Pat. No. 9,732,507.

(60) Provisional application No. 61/894,763, filed on Oct. 23, 2013.

(51) Int. Cl.
*E03D 11/14* (2006.01)
*E03D 11/13* (2006.01)

(52) U.S. Cl.
CPC ..... *E03D 11/14* (2013.01); *E03D 11/13* (2013.01)

(58) Field of Classification Search
CPC ..... E03D 11/13; E03D 11/14; E03D 11/146
USPC ..... 4/252.2, 420, 252.1
See application file for complete search history.

(56) References Cited

U.S. PATENT DOCUMENTS

| | | | | |
|---|---|---|---|---|
| 2,071,337 | A | 2/1937 | Groeniger | |
| D187,854 | S | 5/1960 | Dreyfuss | |
| 3,181,178 | A | 5/1965 | Lerou et al. | |
| 3,576,038 | A | 4/1971 | Dirks et al. | |
| D355,711 | S * | 2/1995 | Nagato | D23/300 |
| 6,979,027 | B2 | 12/2005 | Hetzler et al. | |
| D596,276 | S * | 7/2009 | Espinoza | D23/300 |
| D606,178 | S * | 12/2009 | Cummings | D23/295 |

(Continued)

FOREIGN PATENT DOCUMENTS

KR 2010007395 U 7/2010

OTHER PUBLICATIONS

Notice on the First Office Action issued in Chinese Application No. 2014800580147 dated Dec. 19, 2016.

(Continued)

*Primary Examiner* — Huyen D Le
(74) *Attorney, Agent, or Firm* — Venable LLP; Michele V. Frank

(57) ABSTRACT

A wall hung toilet is described which has a toilet body having a toilet body inlet, a back plate having at least a first and a second lower fastener opening therethrough, a toilet body outlet, a bowl and a base. The bowl has an interior surface defining a interior area for receiving fluid, an inlet for introducing fluid to the interior area of the bowl and a bowl outlet. A trapway for passing fluid from the bowl outlet to the toilet body outlet is also included. The base of the toilet body extends from a front bowl portion of the base to a rear portion of the base that contacts the back plate, and the base is configured so as to distribute load bearing forces when applied to the bowl in use towards each of a first area around the first fastener opening and a second area around the second fastener area.

37 Claims, 10 Drawing Sheets

(56) References Cited

U.S. PATENT DOCUMENTS

| | | | | |
|---|---|---|---|---|
| D621,487 | S | 8/2010 | Toyohara | |
| 7,827,628 | B2 | 11/2010 | Ichiki et al. | |
| 8,032,956 | B2 | 10/2011 | Prokopenko et al. | |
| 8,037,552 | B2 | 10/2011 | Ichiki et al. | |
| 8,122,524 | B2 | 2/2012 | Brescia | |
| 8,321,967 | B2 | 12/2012 | Mesun et al. | |
| 8,544,121 | B1 | 10/2013 | Majocka et al. | |
| D703,797 | S | 4/2014 | Shinozaki | |
| D760,366 | S * | 6/2016 | Cummings | D23/300 |
| D765,228 | S * | 8/2016 | Cummings | D23/300 |
| 9,732,507 | B2 * | 8/2017 | Bucher | E03D 11/14 |
| 2007/0277302 | A1 | 12/2007 | Ichiki et al. | |
| 2012/0186008 | A1 | 7/2012 | Sneve et al. | |
| 2013/0219605 | A1 | 8/2013 | Grover et al. | |
| 2014/0259351 | A1 * | 9/2014 | Spankowski | E03D 11/02 4/420.5 |
| 2015/0107011 | A1 | 4/2015 | Bucher et al. | |

OTHER PUBLICATIONS

PCT International Search Report and Written Opinion in Application No. PCT/US2014/062046 dated Feb. 18, 2015 (8 pages).
PCT International Preliminary Report on Patentability in Application No. PCT/US2014/062046 dated Apr. 26, 2016 (6 pages).
Smith Water Closet Supports Technical Data, Smith Mfg. Co. (5 pages).
Carriers, Fixtures, & Piping, William M. Smith, www.pmengineer.com <http://www.pmengineer.com>, p. 28-33, Feb. 2007 (5 pages).
Adjustable Fixture Supports for Siphon Jet Water Closets, Smith Mfg. Co. Apr. 3, 2012 (1 page).
Notice on the Second Office Action issued in Chinese Application No. 2014800580147 dated Sep. 4, 2017, with English translation (8 pages).

* cited by examiner

WALL-HUNG TOILET WITH IMPROVED LOAD-BEARING CAPACITY

CROSS-REFERENCE TO RELATED APPLICATION

This application is a continuation of U.S. application Ser. No. 14/522,413, filed Oct. 23, 2014, which claims the benefit of the filing date of U.S. Provisional Application No. 61/894,763, filed Oct. 23, 2013, the contents of which are hereby incorporated by reference in their entireties.

BACKGROUND OF THE INVENTION

Field of the Invention

The invention relates to wall-hung toilets, and more particularly to the ability of such toilets to bear the weight of the user when in use.

Description of Related Art

Wall hung toilets, such as those typically found in commercial installations and which generally operate with a flushometer valve or similar device, are designed in the United States to meet several functional criteria, notably the ability to completely remove waste when flushed, to thoroughly cleanse the inside bowl walls upon flushing, to exchange and refill water in the bowl for the next use and to support the weight of the user when seated on the bowl. The UPC code for the weight supporting function requires the toilet to bear a minimum of 500 pounds static load for ten minutes without structural failure.

As the world population, particularly in North America where such standards are applied, increases, so that there are an increasing number of overweight or obese people, there is a need in the art for stronger and more robust wall-hung toilets that can sustain an even greater load-bearing level.

In the North American market, a four-bolt configuration, such as that sold by J.R. Smith Manufacturing Co., Inc. (http.jrsmith.com) is generally known as a common carrier system for commercial wall-hung toilets. A typical wall hung support carrier C is shown as Prior Art in FIG. 1. The rear portion of a commercial wall-hung toilet is configured to have four holes through which bolts are used to mount and attach it to the carrier at locations B shown in FIG. 1. Contact with the carrier C is made only at the areas surrounding the bolt holes. The outward extending position of the bowl when mounted places a torque on the carrier. The area of the toilet around the lower two bolts experiences compressive stress as the weight of the bowl and user, when in use, pushes against the carrier. The upper two bolts serve to keep the bowl in contact with the carrier by pulling it towards the wall on which the bowl is installed. When the maximum load-bearing capacity of the bowl is exceeded, structural failure can occur emanating from one of the four bolt hole areas.

An important design feature of wall hung toilet bowls is the back plate, which is the flat-faced rear portion of the bowl that mates with the carrier when the toilet is installed using a carrier system on a wall surface. The typical commercial carriers such as that of FIG. 1 are designed to bear the load of the bowl at only four bolt positions. Although the bowl when mounted on a carrier system might contact the wall through the carrier in some areas, no significant portion of the load is transferred to it. As such, the back plate design is critically important to the load-bearing aspects of the installation. With reference to a prior art wall hung toilet A sold by the Applicant herein shown in FIG. 2, the back plate D must be able to effectively bridge the load of the toilet and seated user across the span between the lower two bolts which are placed through bolt holes F (typically about 12 in. or more). As the trapway and outlet of a wall hung toilet are generally placed along the centerline L-L' of the bowl (i.e., along the longitudinal midline), existing wall-hung toilets such as that of FIG. 2 tend to concentrate the load on an area near the lower center of the back plate, roughly 50% of the way between the two bolt hole areas. This "upside down T" configuration (see Prior Art FIG. 2 and FIG. 2A) leads to high tensile stress areas and limits the load bearing capability of the design. As shown in FIG. 2, the upside down T is formed by a vector along line L-L' as it falls roughly halfway along line E-E'. The vector of such stress is also shown in FIG. 2A with reference to a force line along a base G of a prior art wall hung toilet toward face plate D and bolts H.

In view of the above issues, some wall hung toilets in the art use the trapway of the toilet as a primary structural load-transferring feature. Such configurations, therefore, also have an "upside down T" in terms of load bearing design, an example of which is in FIG. 2. Attempts to counteract this issue in the art include overcoming structural weakness by increasing the thickness or size of the back plate of the toilet and/or by adding structural support ribs. This has been successful in most cases in order to meet the 500 pound minimum code requirements. However, such designs are generally not sufficient for achieving higher load-bearing capability and such toilets have not achieved high load levels of 1,000 or more.

There continues to be a need in the art for more and improved ways to enhance the load bearing capacity of wall hung toilets.

BRIEF SUMMARY OF THE INVENTION

The wall hung toilet herein includes, in one embodiment, a wall hung toilet, comprising a toilet body having a toilet body inlet, a back plate having at least a first and a second fastener opening therethrough, a toilet body outlet, a bowl and a base; wherein the bowl has an interior surface defining a interior area for receiving fluid, an inlet for introducing fluid to the interior area of the bowl and a bowl outlet; and a trapway for passing fluid from the bowl outlet to the toilet body outlet, wherein the base of the toilet body extends from a front bowl portion of the base to a rear portion of the base that contacts the back plate, and the base is configured so as to distribute load bearing forces when applied to the bowl in use towards each of a first area around the first fastener opening and a second area around the second fastener opening.

In a preferred embodiment, the first and the second fastener openings are situated on a lower portion of the back plate. The toilet body inlet may be configured to receive a flushing fixture. The toilet body may also further comprise a jet and a rim inlet, each for receiving fluid passing through the toilet body inlet. Further, the bowl may be a rimless bowl and the rim inlet may feed water directly into the bowl along the interior surface of the bowl. The toilet body may further comprise a rim that extends substantially around the upper periphery of the bowl and defines a rim channel, and the rim may have an inlet in fluid communication with a manifold beneath the toilet bowl inlet and the rim has at least one rim outlet for allowing fluid to pass from within the rim channel to the interior area of the bowl. In an embodiment with a jet, the jet may define a jet path therethrough and the jet may have an inlet in fluid communication with the manifold and a jet outlet in fluid communication with the interior area of the bowl in a sump area.

In one embodiment, the fastener openings are bolt holes and are each configured for receiving a mounting bolt. In another embodiment, the toilet back plate has at least four fastener openings, wherein each of the fastener openings is a bolt hole configured for receiving a mounting bolt. Two of the at least four fastener openings are preferably in an upper portion of the back plate.

The base preferably has a lower surface and the lower surface has a generally angled V-shaped or curved V-shaped configuration in lower plan view. The base may also have at least one angled wall and the lower surface of the base meets the back plate of the wall-hung toilet at a distance of less than about 5 cm, or less than about 3 cm, wherein the distance is measured transversely from an exterior surface of the angled wall along the back plate to a longitudinal axis through a center of the fastener opening closest to the angled wall. The base may further comprise a second angled wall having an exterior surface, wherein the angled walls define a V-configuration of the base when viewed in a lower plan view, and each angled wall meets the back plate such that the distance measured transversely from the exterior surface of each of the angled walls along the back plate to the longitudinal axis of the closest fastener opening is less than about 5 cm, or less than about 3 cm.

The toilet is preferably capable of bearing a load of at least 1500 pounds in use when fully installed on a wall, and more preferably a load of at least 2,000 pounds in use when fully installed on a wall.

In a further embodiment, the invention includes a wall hung toilet, comprising a toilet body having a toilet body inlet, a back plate having at least a first and a second fastener opening therethrough in a lower portion of the back plate, a toilet body outlet, a bowl, a jet, a rim inlet, a manifold and a base, wherein the manifold is beneath the toilet body inlet for dividing flow between the jet and the rim inlet; wherein the bowl has an interior surface defining a interior area for receiving fluid, an inlet for introducing fluid to the interior area of the bowl and a bowl outlet; and a trapway for passing fluid from the bowl outlet to the toilet body outlet, wherein the base of the toilet body extends from a front bowl portion of the base to a rear portion of the base that contacts the back plate, and the base is configured so as to distribute load bearing forces when applied to the bowl in use towards each of a first area around the first fastener opening and a second area around the second fastener opening.

The toilet body inlet may be configured to receive a flushing fixture. The rim may extend substantially around the upper periphery of the bowl and define a rim channel, and wherein the rim has an inlet in fluid communication with the manifold and at least one rim outlet for allowing fluid to pass from within the rim channel to the interior area of the bowl. The jet may define a jet path within the jet and the jet has an inlet in fluid communication with the manifold and a jet in fluid communication with the interior area of the bowl in a sump area.

The fastener opening may be configured for receiving a mounting bolt. The base preferably has a lower surface and the lower surface has a generally angled V-shaped or curved V-shaped configuration in lower plan view.

In another embodiment, the invention includes a wall hung toilet, comprises a toilet body having a toilet body inlet, a back plate having at least a first and a second fastener opening therethrough in a lower portion of the back plate, a toilet body outlet, a bowl and a base; wherein the bowl has an interior surface defining a interior area for receiving fluid, an inlet for introducing fluid to the interior area of the bowl and a bowl outlet; and a trapway for passing fluid from the bowl outlet to the toilet body outlet, wherein the base of the toilet body extends from a front bowl portion of the base to a rear portion of the base that contacts the back plate, and the base is configured so as to distribute load bearing forces when applied to the bowl in use towards each of a first area around the first fastener opening and a second area around the second fastener opening and wherein the base has a lower surface and the lower surface has a generally angled V-shaped or curved V-shaped configuration in lower plan view. The toilet is preferably capable of bearing a load of at least 1500 pounds in use when fully installed on a wall, and more preferably capable of bearing a load of at least 2,000 pounds in use when fully installed on a wall.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
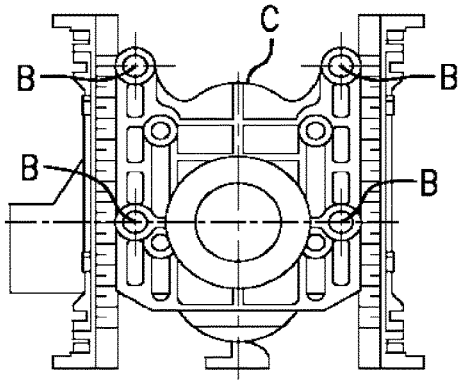
FIG. 1 PRIOR ART
FIG. 1 is a front elevational view of a Prior Art carrier for a wall hung toilet.

The present invention is directed to a wall hung toilet suitable for mounting on a four-hole carrier or similar device such as prior art carrier C of FIG. 1. The toilet is designed to remove the "upside down T" stress vector configuration and instead convey load directly to the carrier at areas close to the lower bolt holes. Such a structural configuration avoids having to form an overly thick back plate while providing a toilet capable of bearing significantly increased load when in use.

As used herein, the wall hung toilet, is a toilet wherein the toilet body is mounted to a wall using a mounting system and not supported by the floor. Such toilets are generally known in the art and come with a variety of features, including direct flush valves, hidden tanks or cisterns if desired, single-, dual- or multi-flush options, various bowl designs and rim, jet and/or trapway configurations. It is within the scope of the invention to adopt any or all of such bowl features in the present invention and benefit from the concept of the present invention to improve such prior art wall hung toilets.

As the concept behind the wall hung toilet herein relies on a structural adjustment, it is further possible to apply the features of the wall hung toilet herein to any wall mounted bath or kitchen fixture not supported by the floor, including sinks, bidets, urinals, fountains, basins and the like. The present invention however, for convenience is being described herein with respect to a wall hung toilet as such fixtures tend to bear the most weight in a wall hung installation. The toilet body will be described with respect to a preferred embodiment shown in FIGS. 3-9 herein. It should be understood, however, that other variations in bowl design, flush mechanisms, inlets, outlets, rim and/or jet design, trapway geometry, fixture surface or body material, and the like can be varied within the scope of the invention and without departing from the spirit thereof.

Figure 8:
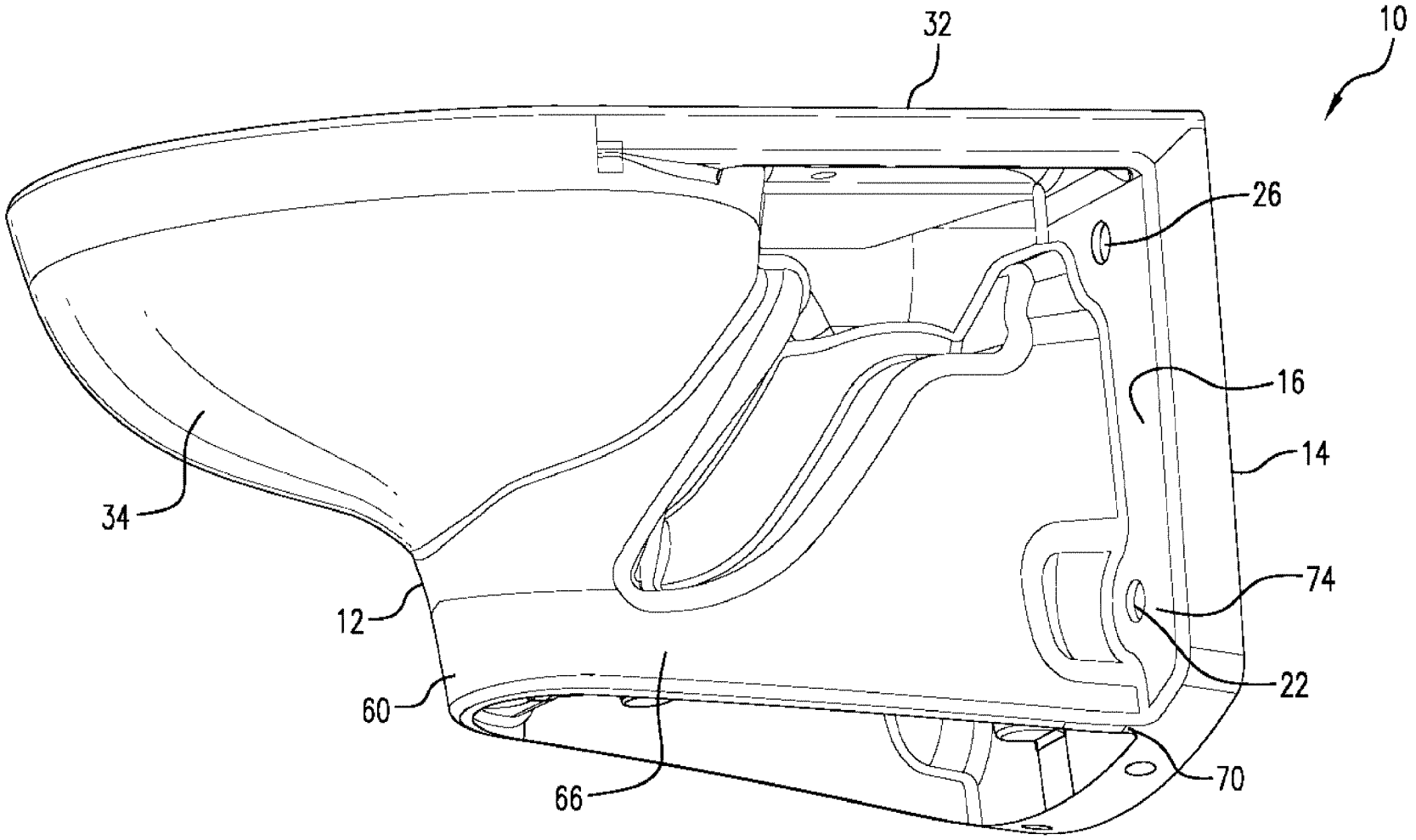
FIG. 8 is an angled right side perspective view of a wall hung toilet as described herein.
Figure 9:
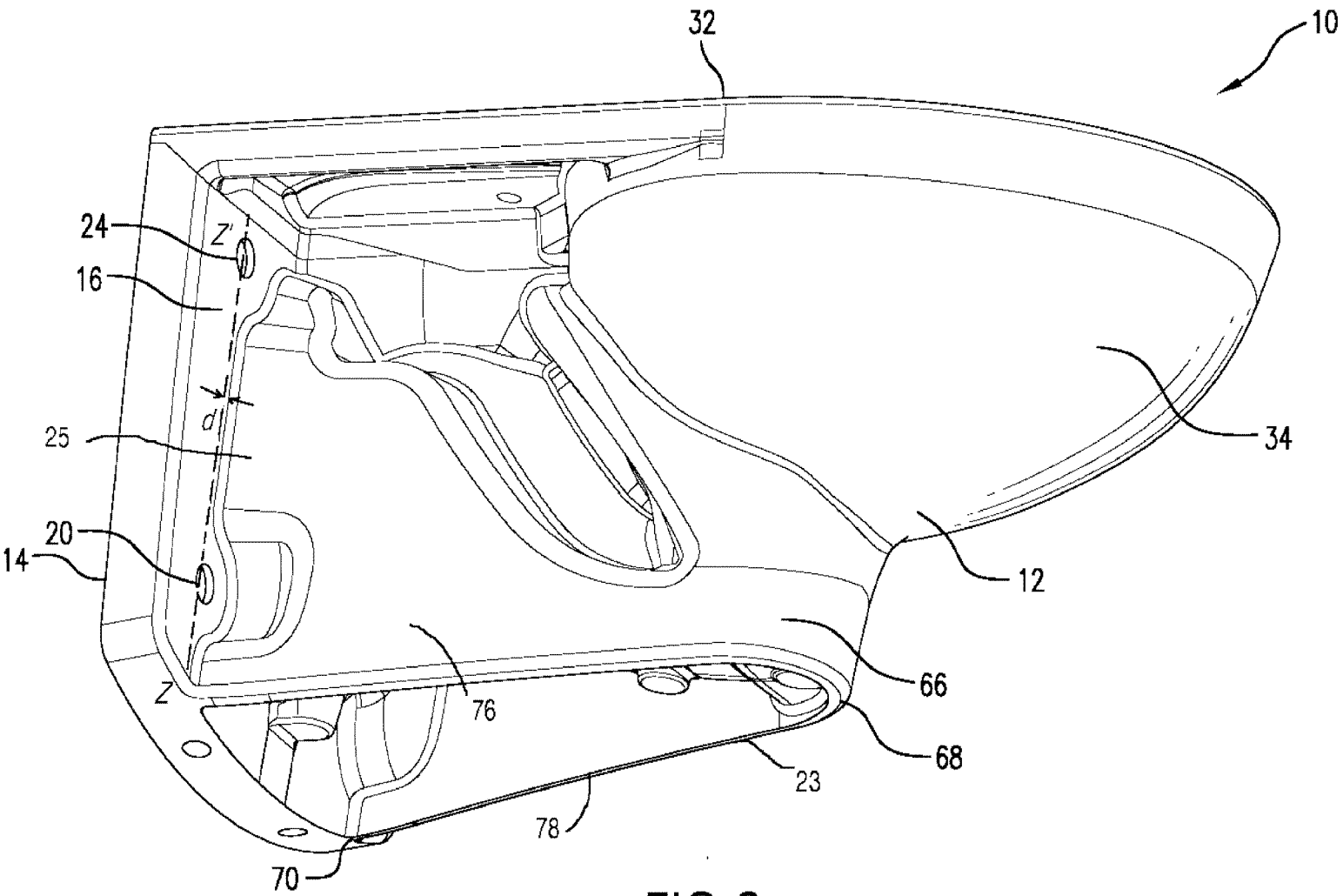
FIG. 9 is an angled left side perspective view of the wall hung toilet of FIG. 8.

With reference to FIGS. 8 and 9, a toilet, generally referred to herein as toilet 10, is shown which has a toilet body 12 and a back plate 14. The toilet body 12 is that portion of the toilet having the basic features of the toilet aside form the back plate. The toilet body and back plate may be formed as a molded part as a single unitary unit using known toilet molding techniques or as two or more separate pieces combined according to standard manufacturing techniques known in the art or to be developed.

The back plate 14 is configured so as to have a preferably flush and smooth front facing surface 16 when viewing the installed toilet from a user's perspective as shown in FIGS. 8 and 9. From the rear view of the back plate, however, the back plate may be, but need not be, a solid surface. As shown, back plate 14 is formed so as to have a solid, flat edge surface 18 which is configured to work with and receive fasteners from a carrier system chosen. The back plate 14 will contact the carrier via the fastener opening to avoid transfer of load to a wall (not shown) when installed. A small gap typically lies between the back plate and the wall on installation and is generally caulked for a neat appearance.

The back plate 14 is further configured to have at least a first and a second fastener opening 20, 22 in a lower portion 19 of the back plate and extending therethrough from the front facing surface 16 toward the back of the back plate 14 for contacting a wall. Mounting bolts (not shown) or threaded rods as are known in the art for wall hung toilet mounting on carriers such as carrier C of FIG. 1 or other fasteners may be passed through openings 20, 22, which may be, for example bolt holes as shown, or holes configured to received a threaded rod, for mounting the wall hung toilet on a wall. The first and second fastener opening 20, 22 are preferably configured (size and cross-sectional shape) to accommodate the selected fastener for use in an installation and/or with a particular carrier assembly. Preferably four such fastener openings, in this case additional openings 24, 26 are also provided for mounting the top of the back plate against a wall. In such an arrangement two additional fastener openings 24, 26 are in an upper portion 21 of the back plate 14, while the first and second fastener openings 20, 22 are preferably in a lower portion 19 of the back plate.

The back surface of the back plate, in addition to an edge surface 18, may include other molded features or reinforcements, for example, in the area of the back of the mounting holes, around the bowl outlet, etc.

The toilet body 12 is molded so as to have a toilet body inlet 28 and a toilet body outlet 30. The inlet 28 may be configured in the manner of any prior art wall hung toilet or standard toilet and is preferably configured to accommodate a fixture for introducing fluid into the toilet body and ultimately into the toilet bowl as described further below. Fluid, such as flush water, may be introduced in a wall hung toilet directly through the back of the toilet body in an inlet conduit into the rear portion of the toilet from behind the back plate, or, as shown herein, be introduced through an inlet 28 positioned on an upper surface 32 of the toilet bowl 34. The flush water may be introduced by a flushometer, a flush valve installed in a casing, exterior unit or within the wall depending on design preference and the flush system and trim chosen. Similarly, activation may be provided for flushing the bowl using a flush handle mounted on the bowl, on a flushometer handle, a wall mounted actuation button or pad, an automatic sensor, or remote controlled flush system as are known in the art. The flush mechanism or activation system is not critical to the invention herein.

The toilet body outlet 30 may be in direct communication with a drain opening to a sewer or to a conduit connecting the outlet to such drain. Further, the toilet body outlet 30 may actually be only the end of one portion of a trapway having an additional portion thereof behind the wall. However, the portion of the toilet body through which flush water exits and passes out of the back plate 14 is the toilet body outlet 30 as that term is used herein.

The toilet body further includes a bowl 34 which may be of a round, elongated, oval, oblong, square, trapezoidal or other design configuration. The bowl 34 is configured to have an interior surface 36 of the bowl 34 that defines an interior area 38 for receiving fluid, and preferably also for retaining sufficient fluid between flush cycles. The interior area 38 includes a lower, sump area 40 having a bowl outlet 42. The bowl 34 preferably also has a bowl inlet 44. The bowl inlet may coincide with the toilet body inlet, but is preferably also some form of rim inlet. The bowl inlet is preferably shaped and/or sized so as to allow for introduction of fluid into the interior area 38 of the bowl 34.

In one embodiment, as exemplified herein, the bowl inlet 44 is in the form of at least one, and preferably as shown, a plurality of openings. In such a configuration, the bowl 34 has a rim 46 that extends substantially around the upper periphery of the bowl and defines a rim channel 48 as is known in the art. The rim channel has an inlet, which may be from a divided flow path (using isolated flow paths from independent valves) or may be from a more natural separation created by the configuration of the rim channel and a toilet manifold 54. The rim channel also has an outlet(s) 52 which may also serve as toilet bowl inlets 44. The rim and flow from the outlets 52 may be pressurized by design of the bowl for enhancement to flushing and cleaning, while conserving water use. The manifold 54 is an area beneath (or in front of) the toilet inlet (depending on the type of toilet design). Flush water entering the toilet inlet would pass through the manifold before going through the rim inlet or, if a jet is provided, the manifold may have two outlets to provide flow to a rim channel inlet as well as to the jet.

A jet 58 for use in the invention may be single or multiple path jetways such as pathway 60 that curve around the toilet bowls herein as are known in the art and may have a variety of configurations within the scope of the invention. The jet introduces a stream of flush water at the bottom of the toilet bowl through a jet outlet 62. Flush water may be introduced to through a jet inlet 64 which also is a manifold outlet. The jet water is preferably of high flow either from a high flow valve or a pump. The water from the jet enters the bottom sump 50 area of the bowl 36.

Rimless toilets and pump pressure designed toilets and bidets are also known and can be used within the scope of the invention herein and benefit therefrom. In such a design, flush water is introduced to a single (or multiple) rim inlet(s) by conduit (in the case of a pump device) or through a single inlet under pressure from another source such as a high flow flush valve. Such rim inlets need not be in a rim channel. For example an upper rim (or periphery in this instance) of a bowl may not define a channel, but extend around the upper portion of the bowl. Interior surface features (such as ledges or concave areas) may be provided to guide water substantially around the rim before dropping to the interior of the bowl for a more vortex flow.

The toilet 10 also includes at least a partial, and preferably a complete, trapway 56 for passing fluid from the bowl outlet to the toilet body outlet.

The toilet body includes a base 66. The base 66 of the toilet body 12 extends from a front bowl portion 68 of the base 66 to a rear portion 70 of the base 66 that contacts the back plate 14. The base 66 is configured so as to distribute load bearing forces when applied to the bowl in use towards each of a first area 72 around the first fastener opening 20 and a second area 74 around the second fastener area 22.

Figure 2:
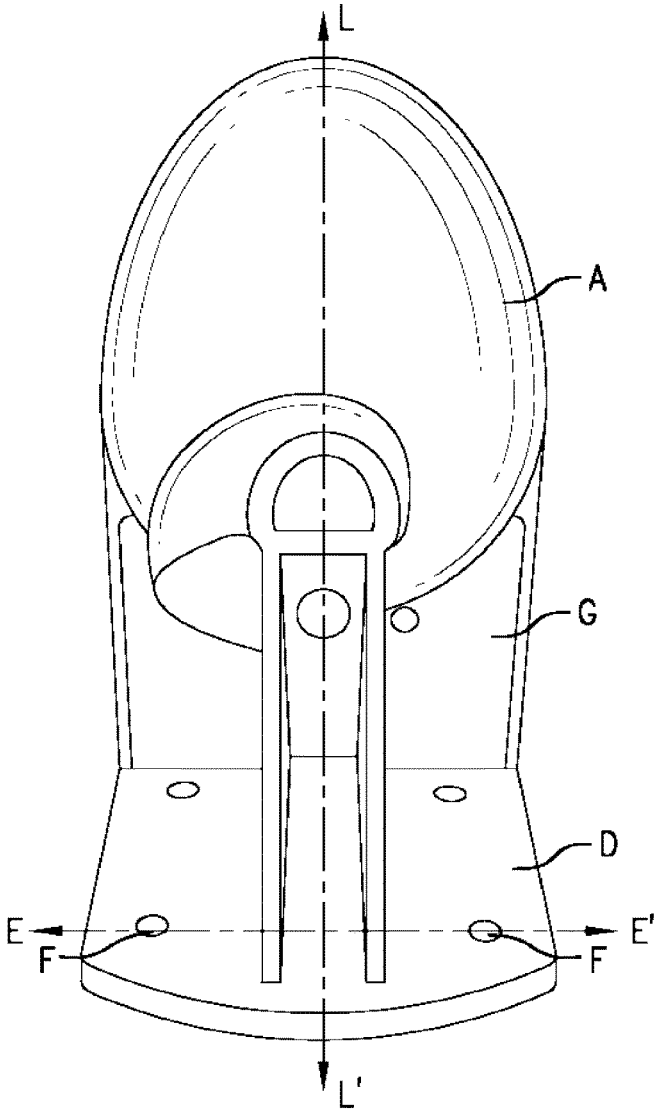
FIG. 2 PRIOR ART
FIG. 2 is a photographic representation of a bottom perspective view of a Prior Art wall hung toilet.
Figure 2B:
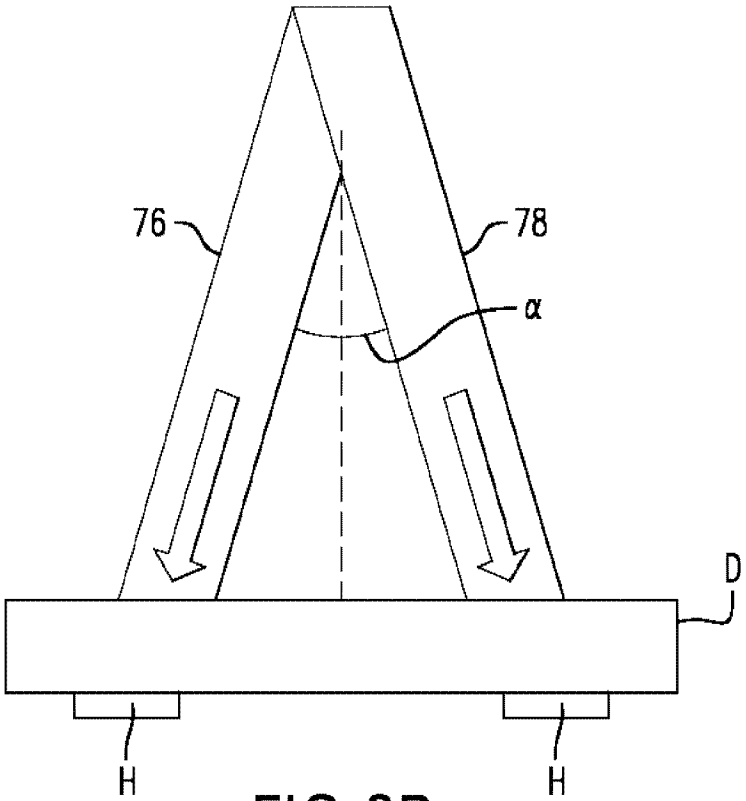
FIG. 2B is a representation of a stress vector configuration of a wall hung toilet according to the present invention.
Figure 2A:
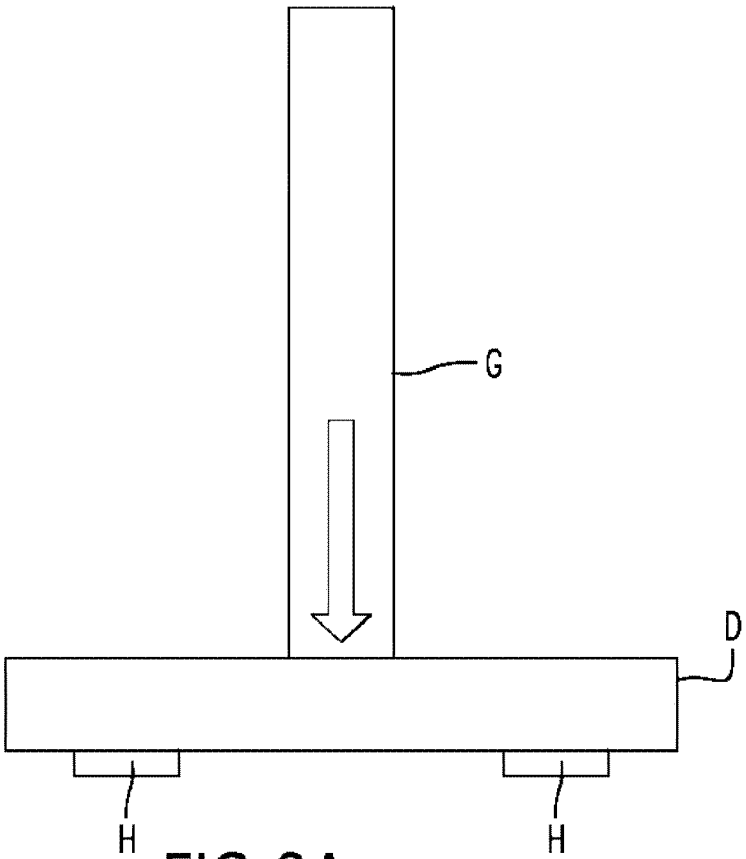
FIG.2A PRIOR ART
FIG. 2A is a representation of an "upside down T" stress vector configuration of an exemplary prior art wall hung toilet such as that of FIG. 2.
Figure 3:
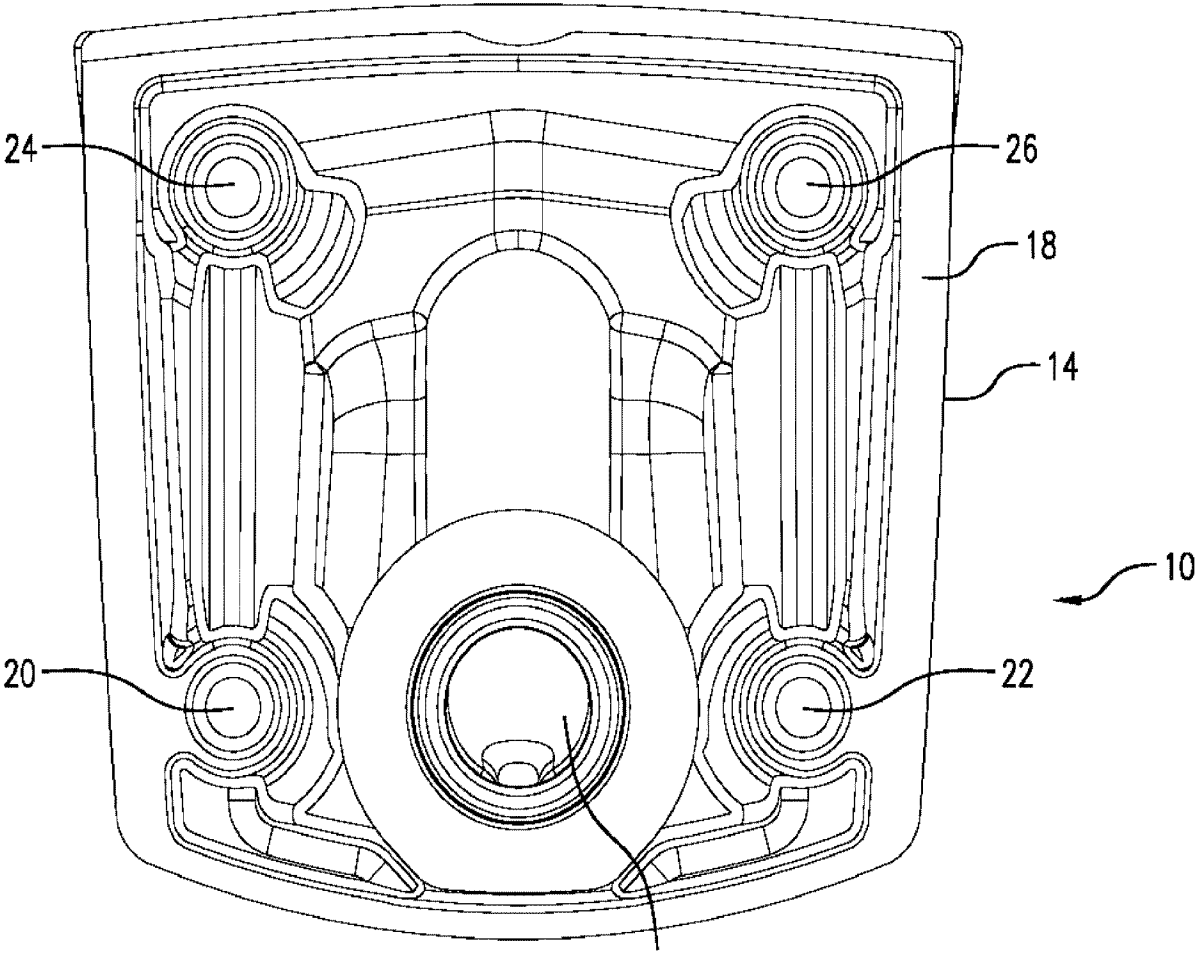
FIG. 3 is a back plan view of a wall hung toilet described herein and shown in FIG. 8.
Figure 4:
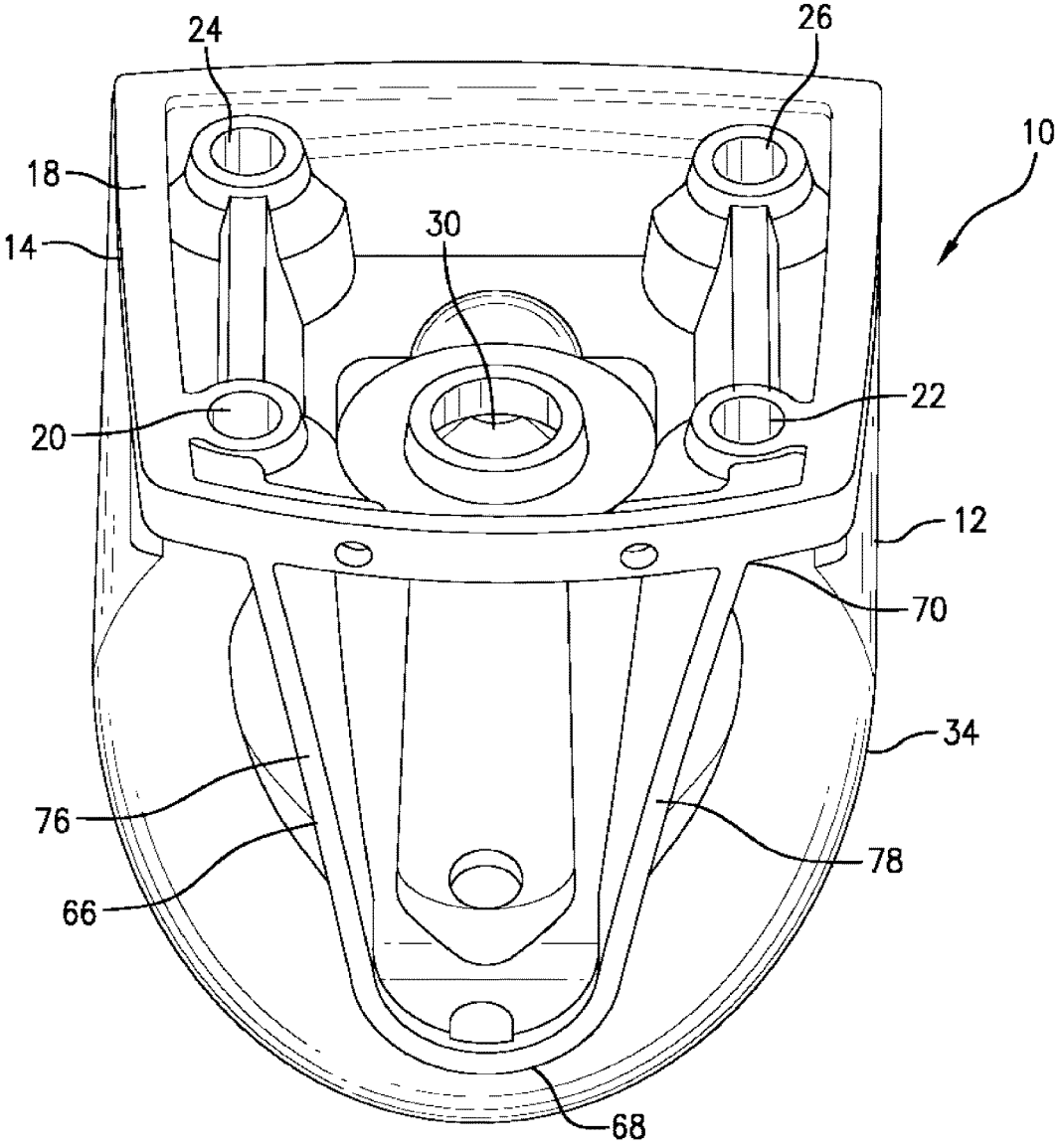
FIG. 4 is a rear and bottom perspective view of the wall hung toilet of FIG. 8.
Figure 5:
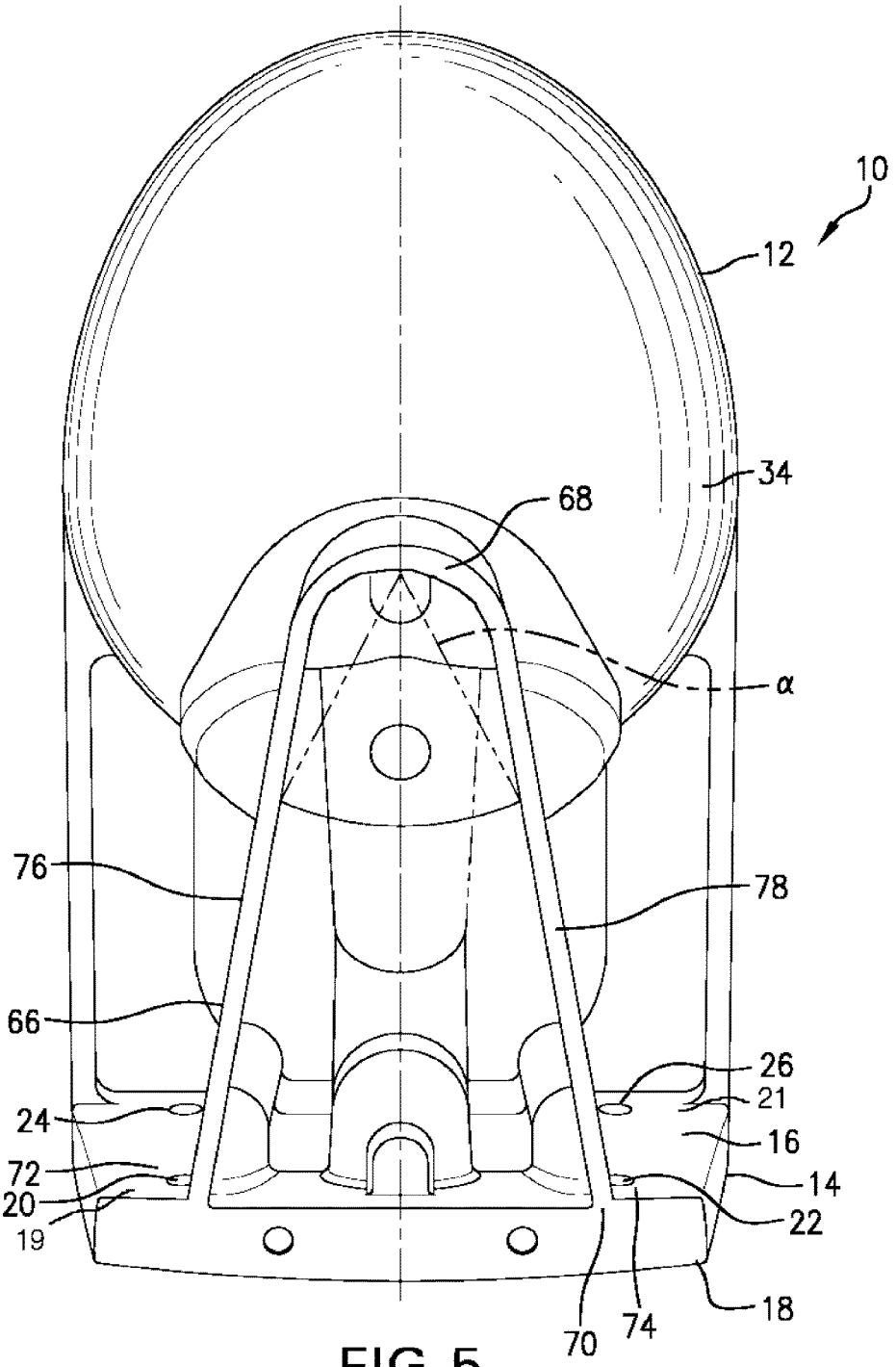
FIG. 5 is a bottom perspective view of the wall hung toilet of FIG. 8.
Figure 6:
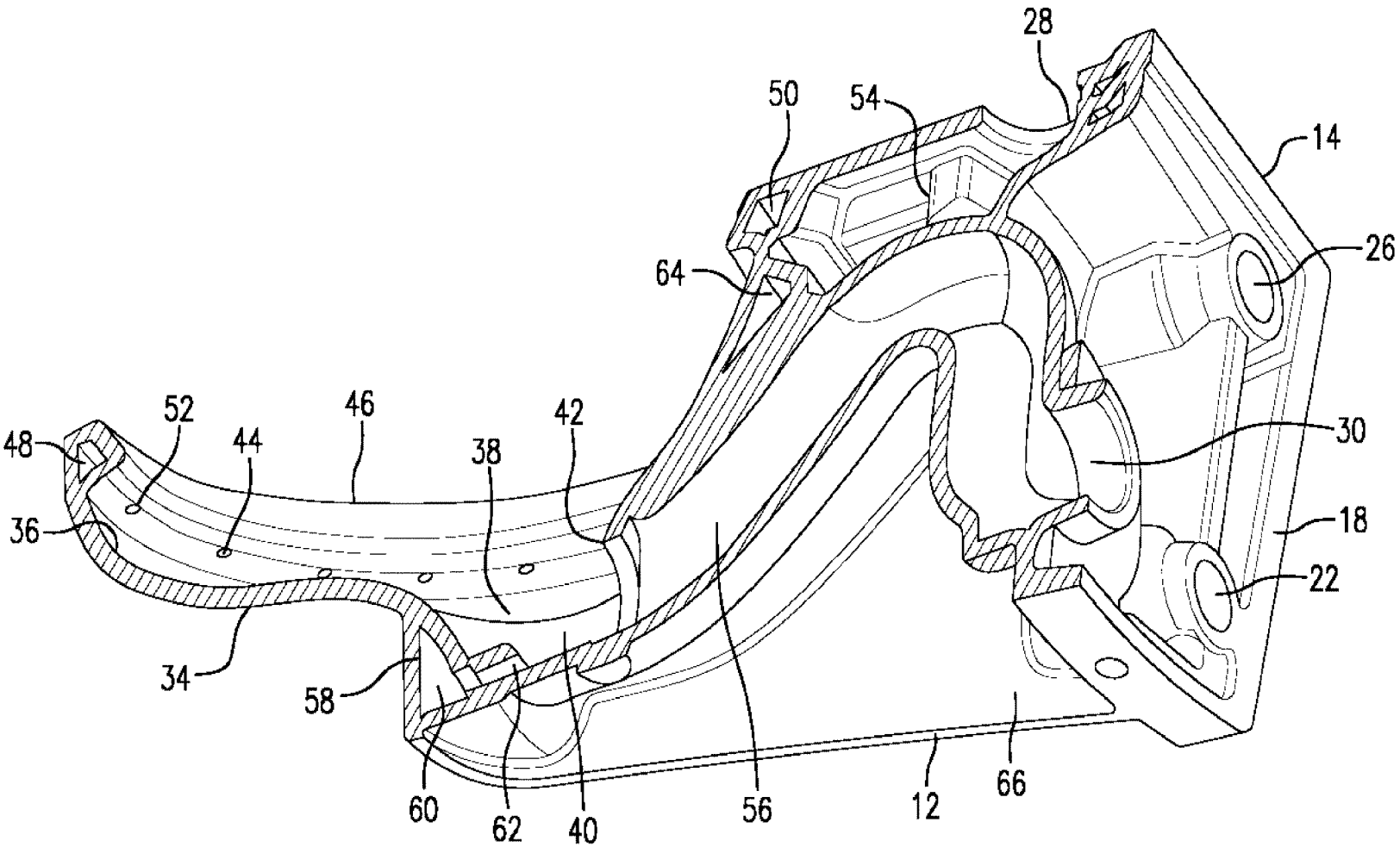
FIG. 6 is a partial cross-sectional view of the wall hung toilet of FIG. 8 showing a portion of the jet path and the trapway path within the interior of the wall hung toilet.
Figure 7:
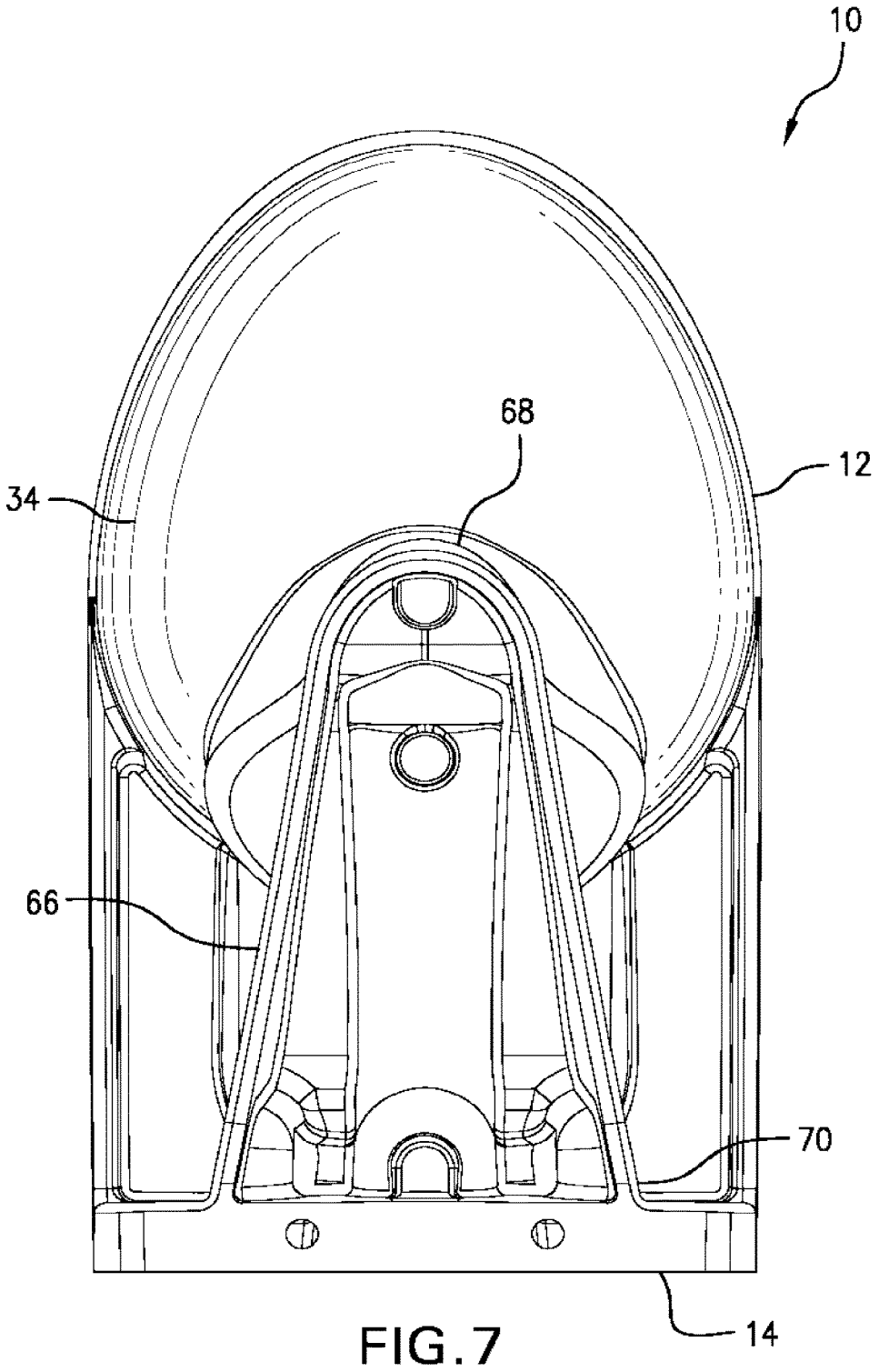
FIG. 7 is a bottom plan view of the wall hung toilet of FIG. 8.

An example of this may be seen not only by the curved V-shaped configuration of the bottom of the base 66 when viewed in a bottom plan view so as to view the lower surface 23 of the base, but also with respect to FIG. 2B. The curved V-shape is preferred for aesthetic reasons, however, a more angled V-shape is also within the scope of the invention. The base 66 includes at least one angled wall 76, the lower surface of which is the same as the lower surface 23 of the base. The at least one angled wall 76 meets the back plate of the toilet at a distance d measured transversely along the back plate from the exterior surface 25 of the angled wall 76 to a longitudinal axis Z-Z' extending longitudinally on the back plate through the center of the closest fastener opening to the exterior surface 25 of the angled wall. If the upper and lower fastener openings are aligned, the axis Z-Z' would extend through two of such fastener openings. The distance d is preferably no more than about 5 cm, or no more than about 3 cm.

Preferably, as shown there are two angled walls, 76, 78 which merge at the front of the base in either a point (angled V) or curve (curved V) to define a V-shaped configuration. The lower surface 23 of each, which is also the lower surface of the base, in such a design is continuous. The angled walls 76, 78 preferably form an acute angle $\alpha$ between the walls formed when the walls are directed toward the areas 72, 74 around the fastener openings 20, 22 in the lower portion 19 of the back plate 14. The angle formed distributes the load so as to form an angled vector as shown in FIG. 2B. Each wall is preferably a distance d of no greater than about 5, or no greater than about 3 as measured along the base plate transversely from the exterior surface 25 of each wall (which in this design would also be continuous over both walls on the base) to the closest fastener opening.

When failure generally occurs using such a design, it is located generally at one of the two fasteners inserted through the fastener openings at the top of the back plate. In nearly all cases, the toilet remains mounted to the carrier by the remaining fasteners, preferably three additional fasteners, which helps to prevent injury in the event of a field failure. In most prior art designs, failure occurs in a catastrophic manner emanating from one of the bottom two fastener openings and often results in the bowl falling from the carrier to the floor with the result of occurrences of injury.

The wall hung toilet herein is capable of bearing a load of at least about 1,500 pounds when fully installed using a carrier system or other mounting system on a wall and bearing weight by a user. In some embodiments herein, the toilet is capable of bearing a load of at least about 1,500 pounds, more preferably at least about 1,700 pounds, and most preferably at least about 2,000 pounds, in use when fully installed on a wall.

The invention will now be described in connection with the following non-limiting example:

EXAMPLE

Figure 10:
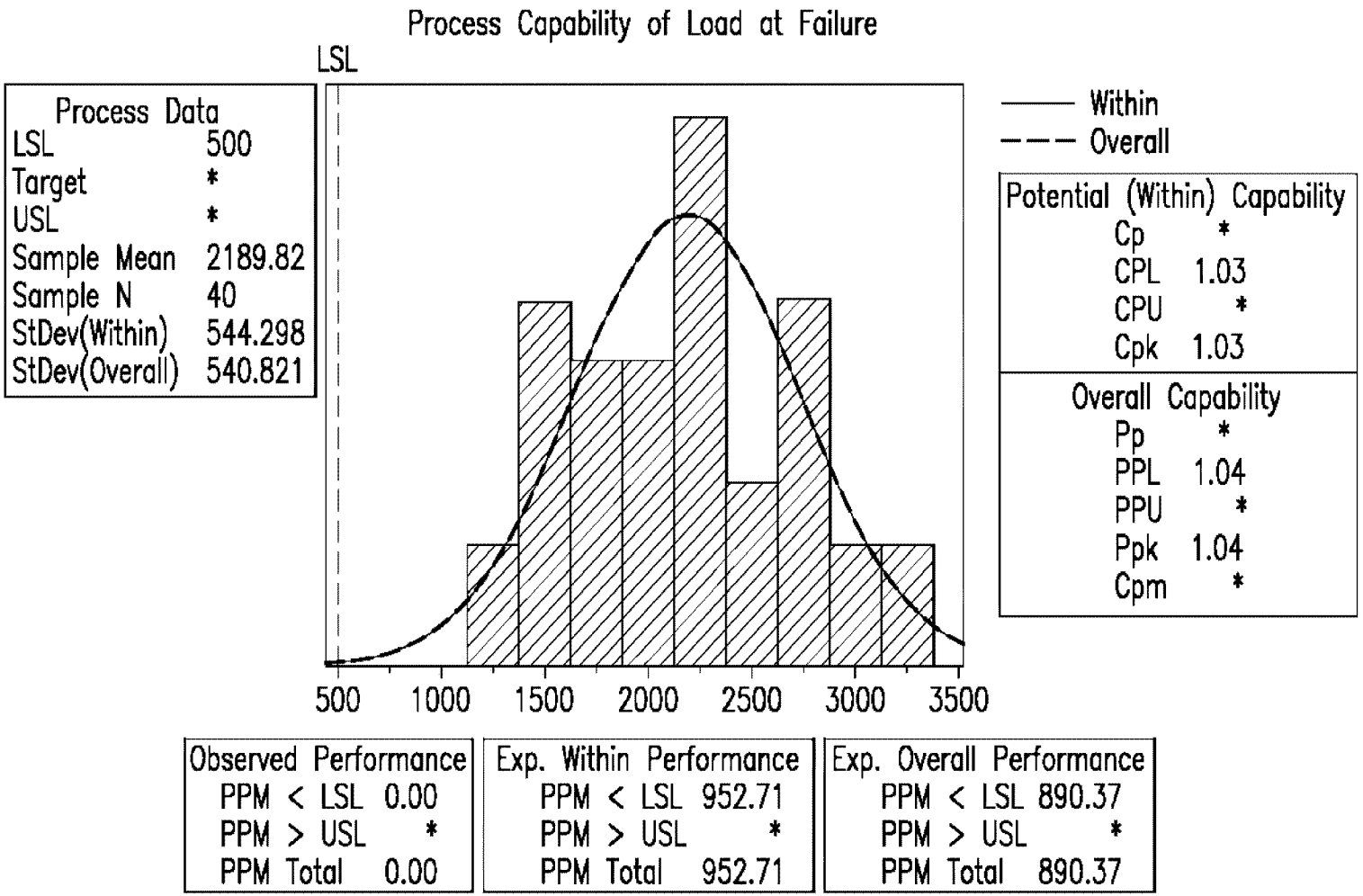
FIG. 10 is a representation of performance data for evaluation of the process capacity of load.

Chinaware wall hung toilet samples were formed according to the present invention as shown in FIGS. 3-8. They were subjected to load testing by applying a steadily increasing load and the load at which the ceramic failed was recorded. The average load at failure for 40 samples tested was 2,190 pounds, which was over three times the minimum code requirement. The flush performance of the samples was also outstanding scoring over 1,000 g on the MaP test. FIG. 10 shows the performance data for evaluation of the process capacity of load.

The inventive product is also advantageous from a manufacturing standpoint in that it can be cast in a relatively standard, seven piece mold system. Geometric features of the trapway, critical for flush performance, are formed by the foot core, side wall and back core molds.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A wall hung toilet for distributing load bearing forces to enhance a load bearing capacity of the toilet, comprising a back plate, a bowl and a base, wherein the back plate comprises a first fastener opening and a second fastener opening, and wherein the base extends from a front bowl portion of the base to a rear portion of the base, wherein the base comprises a lower surface comprising two angled walls which merge at a front of the base in a generally angled V-shaped or curved V-shaped configuration in lower plan view, and the base is configured to distribute load bearing forces when applied to the bowl in use towards each of a first area around the first fastener opening and a second area around the second fastener opening, and wherein a width of the back plate is wider than a width between the two angled walls such that the back plate has a front facing surface visible from a user's perspective.

2. The wall hung toilet according to claim 1, further comprising a toilet body having a toilet body inlet, wherein the toilet body inlet is configured to receive a flushing fixture.

3. The wall hung toilet according to claim 1, further comprising a toilet body, wherein the toilet body further comprises a jet inlet and a rim inlet, each for receiving fluid passing through a toilet body inlet.

4. The wall hung toilet according to claim 1, further comprising a toilet body, wherein the toilet body further comprises a rim that extends substantially around an upper periphery of the bowl and defines a rim channel, and wherein the rim has an inlet in fluid communication with a manifold beneath a toilet bowl inlet and the rim has at least one rim outlet for allowing fluid to pass from within the rim channel to an interior area of the bowl.

5. The wall hung toilet according to claim 4, further comprising a jet, wherein the jet defines a jet path therethrough and the jet has an inlet in fluid communication with the manifold and a jet outlet in fluid communication with an interior area of the bowl in a sump area.

6. The wall hung toilet according to claim 1, wherein the first fastener opening and the second fastener opening are each a bolt hole configured for receiving a mounting bolt.

7. The wall hung toilet according to claim 1, further comprising at least four fastener openings, wherein each of the fastener openings is a bolt hole configured for receiving a mounting bolt.

8. The wall hung toilet according to claim 7, wherein two of the at least four fastener openings are in an upper portion of the back plate.

9. The wall hung toilet according to claim 1, wherein the two angled walls comprise a first angled wall that meets the back plate at a distance measured transversely from an exterior surface of the first angled wall to a longitudinal axis through a center of the first fastener opening.

10. The wall hung toilet according to claim 9, wherein the distance from the exterior surface of the first angled wall to the longitudinal axis through the center of the first fastener opening is less than about 5 cm.

11. The wall hung toilet according to claim 9, wherein the two angled walls comprise a second angled wall, wherein the first angled wall merges with the second angled wall at the front of the base at an acute angle.

12. The wall hung toilet according to claim 11, wherein the second angled wall meets the back plate at a distance between an exterior surface of the second angled wall and the longitudinal axis of the second fastener opening.

13. The wall hung toilet according to claim 1, wherein the wall hung toilet is capable of bearing a load of at least 1500 pounds in use when fully installed.

14. The wall hung toilet according to claim 13, wherein the wall hung toilet is capable of bearing a load of at least 2,000 pounds in use when fully installed.

15. A wall hung toilet, comprising a toilet body having a toilet body inlet, a back plate comprising a first fastener opening and a second fastener opening, a toilet body outlet, a bowl, a jet, a rim inlet, a manifold, and a base, wherein the manifold is beneath the toilet body inlet for dividing flow between the jet and the rim inlet;

wherein the bowl has an interior surface defining an interior area for receiving fluid, a bowl inlet for introducing fluid to the interior area of the bowl and a bowl outlet; and a trapway for passing fluid from the bowl outlet to the toilet body outlet, wherein the base comprises a lower surface comprising two angled walls which merge at a front of the base in a generally angled V-shaped or curved V-shaped configuration in lower plan view and the base is configured so as to distribute load bearing forces when applied to the bowl in use towards each of a first area around the first fastener opening and a second area around the second fastener opening, and wherein a width of the back plate is wider than a width between the two angled walls such that the back plate has a front facing surface visible from a user's perspective.

16. The wall hung toilet according to claim 15, wherein the toilet body inlet is configured to receive a flushing fixture.

17. The wall hung toilet according to claim 15, wherein a rim of the bowl extends substantially around an upper periphery of the bowl and defines a rim channel, and wherein the rim has an inlet in fluid communication with the manifold and at least one rim outlet for allowing fluid to pass from within the rim channel to the interior area of the bowl.

18. The wall hung toilet according to claim 15, wherein the jet defines a jet path within the jet and the jet has an inlet in fluid communication with the manifold and a jet in fluid communication with the interior area of the bowl in a sump area.

19. The wall hung toilet according to claim 15, further comprising a fastener opening is configured for receiving a mounting bolt.

20. A wall hung toilet configured to distribute load bearing forces, comprising a toilet body, a bowl, a back plate having upper fastener openings and lower fastener openings, and a base, the base having a centerline aligned in parallel with a trapway centerline, wherein the base has a load vector configured to transfer load toward the lower fastener openings when applied to the bowl in use towards an area around each of the lower fastener openings.

21. The wall hung toilet according to claim 20, wherein the toilet is capable of bearing a load of at least 1500 pounds in use when fully installed on a wall.

22. The wall hung toilet according to claim 21, wherein the toilet is capable of bearing a load of at least 2,000 pounds in use when fully installed on a wall.

23. The wall hung toilet according to claim 1, wherein the two angled walls comprise a first angled wall configured to contact the back plate at an angle.

24. The wall hung toilet according to claim 23, wherein the two angled walls comprise a second angled wall configured to merge with the first angled wall at an angle.

25. The wall hung toilet according to claim 1, wherein the first fastener opening and the second fastener opening are lower fastener openings and wherein the back plate further comprises upper fastener openings.

26. The wall hung toilet according to claim 1, wherein the base has a load vector, the load vector including a first load vector and a second load vector, non-parallel with the first load vector.

27. The wall hung toilet according to claim 26, wherein the base further comprises a centerline aligned in parallel with a centerline of a trapway, and wherein the first load vector and second load vector are non-parallel with the base centerline.

28. The wall hung toilet of claim 15, the base further comprising a first angled wall and wherein a lower surface of the first angled wall meets the back plate at a distance measured transversely from an exterior surface of the first angled wall to a longitudinal axis through a center of the first fastener opening.

29. The wall hung toilet of claim 15, the base further comprising a first angled wall and a second angled wall, wherein the first angled wall merges with the second angled wall at an acute angle.

30. The wall hung toilet according to claim 15, wherein the first fastener opening and the second fastener opening are lower fastener openings and wherein the back plate further comprises upper fastener openings.

31. The wall hung toilet according to claim 15, wherein the base has a load vector, the load vector including a first load vector and a second load vector, non-parallel with the first load vector.

32. The wall hung toilet according to claim 31, wherein the base further comprises a centerline aligned in parallel with a centerline of the trapway, and wherein the first load vector and second load vector are non-parallel with the base centerline.

33. The wall hung toilet of claim 20, the base further comprising a first angled wall and a second angled wall, wherein the first angled wall merges with the second angled wall at an acute angle.

34. The wall hung toilet of claim 20, the base further comprising a first angled wall, the first angled wall configured to meet the back plate at an angle.

35. The wall hung toilet according to claim 20, wherein the base load vector includes a first load vector and a second load vector, non-parallel with the first load vector.

36. The wall hung toilet according to claim 35, wherein the first load vector and second load vector are non-parallel with the base centerline.

37. The wall hung toilet of claim 1, wherein the first fastener opening and the second fastener opening are situated on a lower portion of the back plate.

* * * * *